US009263805B2

(12) United States Patent
Hay

(10) Patent No.: US 9,263,805 B2
(45) Date of Patent: Feb. 16, 2016

(54) RECONFIGURABLE SELF COMPLEMENTARY ARRAY

(75) Inventor: Stuart Hay, New South Wales (AU)

(73) Assignee: Commonwealth Scientific and Industrial Research Organisation, Australian Capital Territory (AU)

( * ) Notice: Subject to any disclaimer, the term of this patent is extended or adjusted under 35 U.S.C. 154(b) by 279 days.

(21) Appl. No.: 13/809,040

(22) PCT Filed: Jul. 7, 2011

(86) PCT No.: PCT/AU2011/000862

§ 371 (c)(1),
(2), (4) Date: Jan. 8, 2013

(87) PCT Pub. No.: WO2012/003546

PCT Pub. Date: Jan. 12, 2012

(65) Prior Publication Data

US 2013/0113678 A1 May 9, 2013

(30) Foreign Application Priority Data

Jul. 8, 2010 (AU) ..... 2010903043

(51) Int. Cl.

| | |
|---|---|
| ***H01Q 1/50*** | (2006.01) |
| ***H01Q 21/00*** | (2006.01) |
| ***H01Q 21/06*** | (2006.01) |
| ***H01Q 21/22*** | (2006.01) |

(52) U.S. Cl.
CPC ..... *H01Q 21/0006* (2013.01); *H01Q 21/065* (2013.01); *H01Q 21/22* (2013.01)

(58) Field of Classification Search
CPC ..... H01Q 21/22; H01Q 21/065
See application file for complete search history.

(56) References Cited

U.S. PATENT DOCUMENTS

| | | | | |
|---|---|---|---|---|
| 5,105,300 | A | 4/1992 | Gnehm | |
| 6,175,723 | B1 * | 1/2001 | Rothwell, III | 455/63.1 |
| 7,173,565 | B2 * | 2/2007 | Sievenpiper | 343/700 MS |
| 7,839,350 | B2 * | 11/2010 | Nagai | 343/850 |
| 2003/0201941 | A1 * | 10/2003 | Aikawa et al. | 343/700 MS |
| 2004/0012529 | A1 | 1/2004 | Teshirogi et al. | |
| 2005/0259008 | A1 | 11/2005 | Gustafsson | |
| 2006/0284783 | A1 * | 12/2006 | Mohamadi | 343/853 |
| 2008/0012770 | A1 | 1/2008 | Hook et al. | |

FOREIGN PATENT DOCUMENTS

| | | |
|---|---|---|
| GB | 2 251 729 A | 7/1992 |
| JP | 49-60856 | 6/1974 |

(Continued)

OTHER PUBLICATIONS

European Search Report and Written opinion dated Mar. 14, 2013 for corresponding European Application No. 11803022.0, 7 pages.

Mushiake, Y., A Report on Japanese Development of Antennas: from the Yagi-uda antenna to self-complementary antennas, *IEEE Antennas and Propagation Magazine*, vol. 46, No. 4, p. 47-60 (Aug. 2004), 14 pages.

(Continued)

*Primary Examiner* — Trinh Dinh
(74) *Attorney, Agent, or Firm* — Brinks Gilson & Lione

(57) ABSTRACT

An antenna structure for the transmission or receipt of electromagnetic signals, the structure formed as a self complementary array having a series of high and low impedance patches, with predetermined low impedance patches interconnected to one another by an impedance matching amplifier network so as to provide self complementary properties.

13 Claims, 9 Drawing Sheets

(56) References Cited

FOREIGN PATENT DOCUMENTS

| | | |
|---|---|---|
| KR | 2003 0067958 | 10/2005 |
| WO | WO2005/069437 | 7/2005 |

OTHER PUBLICATIONS

Japanese Office Action dated Dec. 1, 2014 for corresponding Japanese Application No. 2013-516913, 5 pages (citing JP 49-60856).

* cited by examiner

20

RECONFIGURABLE SELF COMPLEMENTARY ARRAY

CROSS-REFERENCE TO RELATED APPLICATIONS

The present application is the national phase of International Application No. PCT/AU2011/000862, entitled "Reconfigurable self complementary array", filed on Jul. 7, 2011, which claims the priority benefit to Australian application 2010903043, filed on Jul. 8, 2010, each of which are incorporated herein by reference in their entirety.

FIELD OF THE INVENTION

The present invention relates to antenna transceivers and, in particular, discloses a beamforming array able to handle a large range of frequencies.

BACKGROUND

Any discussion of the prior art throughout the specification should in no way be considered as an admission that such prior art is widely known or forms part of common general knowledge in the field.

In the area of wireless transmission and reception, it is of increasingly important is that the wireless transmissions are carried out to in an efficient manner.

Various self complementary array antenna structures are known. For example, see Self-complementary antennas. Y Mushiake IEEE Antennas & Propagation Magazine, 1992, 34:66, 23-29. Self complementary antenna structures are characterised by terminal impedances that are independent of the radio frequency, enabling the antenna to efficiently couple the electromagnetic energy of waves in space to electrical circuits over a large frequency range. A number of multi-terminal or array antennas that are self complementary are known, as discussed in the aforementioned article.

SUMMARY

It is an object of the present invention to provide an improved form of self complementary antenna array.

In accordance with a first aspect of the present invention, there is provided an antenna structure for the transmission or receipt of electromagnetic signals, the structure formed as a self complementary array having a series of high and low impedance patches, with predetermined low impedance patches interconnected to one another by an impedance matching amplifier network so as to provide self complementary properties.

Preferably, the low impedance patches substantially form a checkerboard pattern. The impedance matching amplifier network can be switched between a number of different self complementary states. The vertices of substantially adjacent patches are preferably electrically interconnected. The vertices are preferably electrically interconnected utilising low noise amplifiers.

In some embodiments, a ground plane structure can be provided a predetermined distance from the high and low impedance patches. The ground plan structure can be substantially planar and can be substantially one quarter of the desired operating wavelength distance from the high and low impedance patches. The low impedance patches spacing can be less than one half the desired operating wavelength. A series of low noise amplifiers can interconnect predetermined ones of the patches through the ground plane structure. The patches are preferably substantially diamond or square shaped.

In some embodiments, the impedance of the electrical interconnection preferably can include complementary pairs z and zc of reactive impedances substantially satisfying $z \times zc = (z0/2) \times (z0/2)$, where z0 can be approximately 377 ohms In accordance with a further aspect of the present invention, there is provided an antenna structure for the transmission or receipt of electromagnetic signals, the structure formed as a self complementary array having a series of high and low impedance areas interconnected with a switchable impedance matching network.

BRIEF DESCRIPTION OF THE DRAWINGS

Benefits and advantages of the present invention will become apparent to those skilled in the art to which this invention relates from the subsequent description of exemplary embodiments and the appended claims, taken in conjunction with the accompanying drawings, in which:

DETAILED DESCRIPTION

Figure 1:
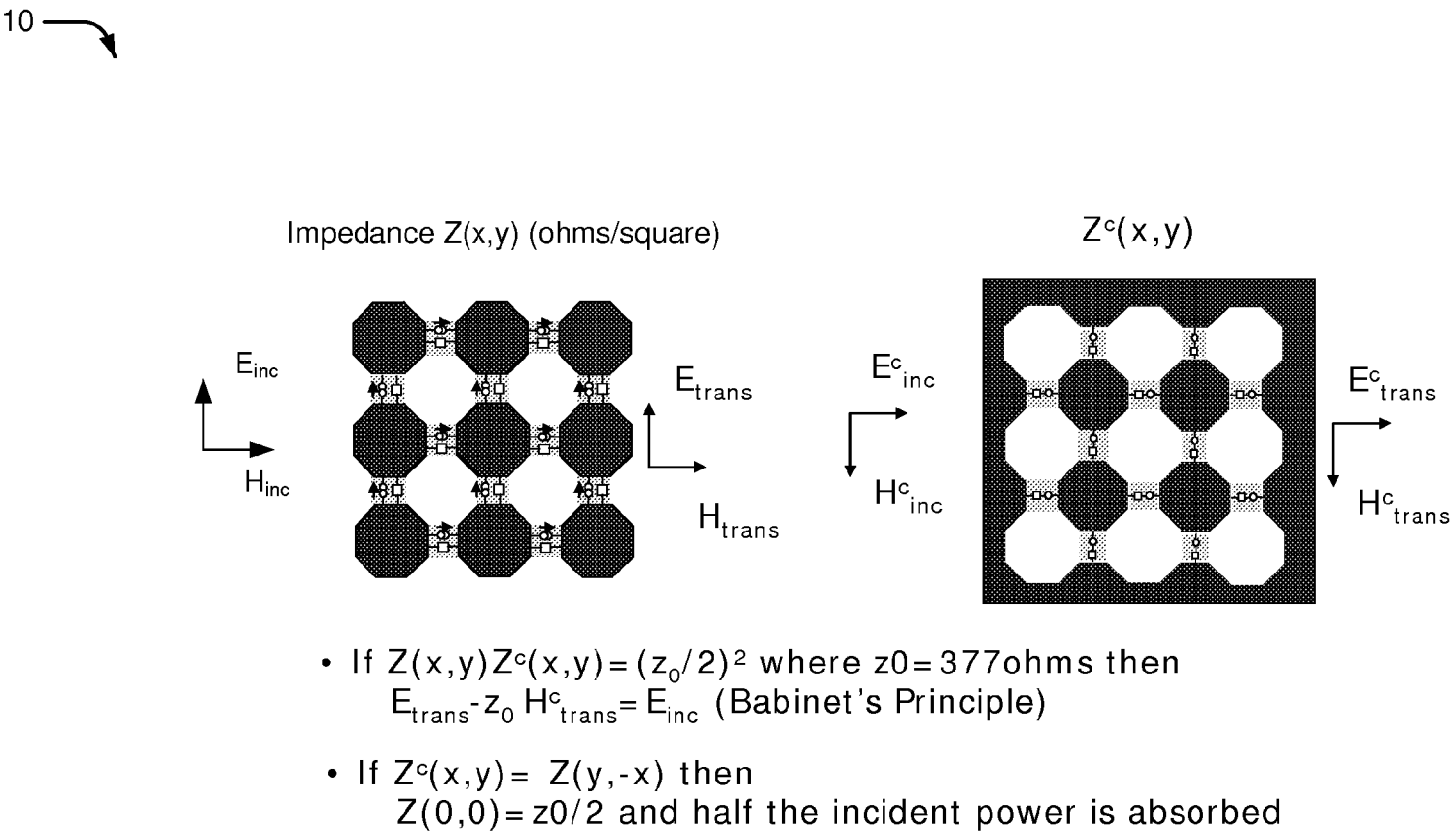
FIG. 1 provides an illustration of the Babinet's principle and the corollary of self-complementary antennas.

Preferred embodiments of the invention will now be described, by way of example only, with reference to the accompanying drawings.

In the preferred embodiments, there is provided a multi-terminal antenna that can be switched between self-complementary configurations of varying terminal density. The preferred embodiment thereby provides the advantage in the ability to adapt the array antenna to the radio frequency and or the spatial frequency of an electromagnetic wave so that redundancy is removed from the individual array signals and hence complexity is minimized in the associated beamforming circuits where the array signals are combined.

This is especially important where the accuracy and flexibility of costly digital beamforming is required. Minimum redundancy can be achieved at each frequency by configuring the spatial separation of the array terminals to be a certain fraction of the wavelength. Efficient energy coupling between the electromagnetic wave and the circuits is maintained as the array is reconfigured because each configuration is self complementary. The resultant antenna provides an array antenna capable of operating efficiently over a wide frequency range with spatial reconfiguration of the array elements.

The antenna structure has a number of uses. One use is in large wideband radio telescope arrays, such as the proposed Square Kilometre Array. In this area, there is a strong desire to perform necessary beamforming of the array signals in the digital domain, with the result that the cost of the digital beamforming is a large part of the overall system cost.

Through the utilisation of a reconfigurable array, there is provided the ability to reconfigure the spacing and number of the array elements. This can greatly reduce the redundancy in the array signals and hence allow significantly improved use of a digital processing capability. Thus the processed bandwidth can be greatly increased at the low end of the overall frequency range, enabling a large increase in survey speed. Another application of a reconfigurable self complimentary array is in the area of self-organizing or cognitive wireless communications, where the reconfigurable array can adapt to best suit changing requirements or changing environments.

The preferred embodiments provide an antenna array able to be switched between different self-complementary states.

The preferred embodiment includes a modification of a checkerboard array as constructed in the prototype focal-plane array for the Australian Square Kilometre Array Pathfinder (ASKAP). The checkerboard array is made to be reconfigurable, with the reconfigurable self-complementary array concept introducing new self-complementary states and also switching between self-complementary states.

Self-Complementary Arrays

The concept of self-complementary antennas is derived from the electromagnetic form of Babinet's principle that states that the diffraction pattern from an opaque body is identical to that from a hole of the same size and shape except for the overall forward beam intensity.

As illustrated in FIG. 1, Babinet's principle refers to the concept of a planar surface impedance distribution. The figure shows a first impedance surface Z(x,y) 11 and also the complementary impedance Zc(x,y) 12 defined by the relation Z(x,y)Zc(x,y)=(z0/2)(z0/2) where z0=377 ohm is the impedance of free space.

The electromagnetic form of the principle also refers to an electromagnetic field incident on Z(x,y) 11 and a complementary field incident on Zc(x,y) 12. Considering the case where the field 13 incident on Z(x,y) 11 is a plane wave propagating in the direction normal to the page. In this case, the complementary field 14 incident on Zc(x,y) 12 is just the original field with the field vectors rotated about the direction of propagation by 90°.

As given in FIG. 1, Babinet's principle then gives a very simple relationship between the reflected and transmitted fields in the two case of Z(x,y) and Zc(x,y).

A corollary to this is that at any point about which a 90°-rotation of the screen is the same as the complementary screen, the screen is self complementary and the impedance at this point is Z0/2, independent of frequency. This impedance may be provided by an electronic circuit and the frequency-independence allows the antenna to be well-matched to this circuit, transmitting or receiving efficiently, over a large frequency range.

Figure 2:
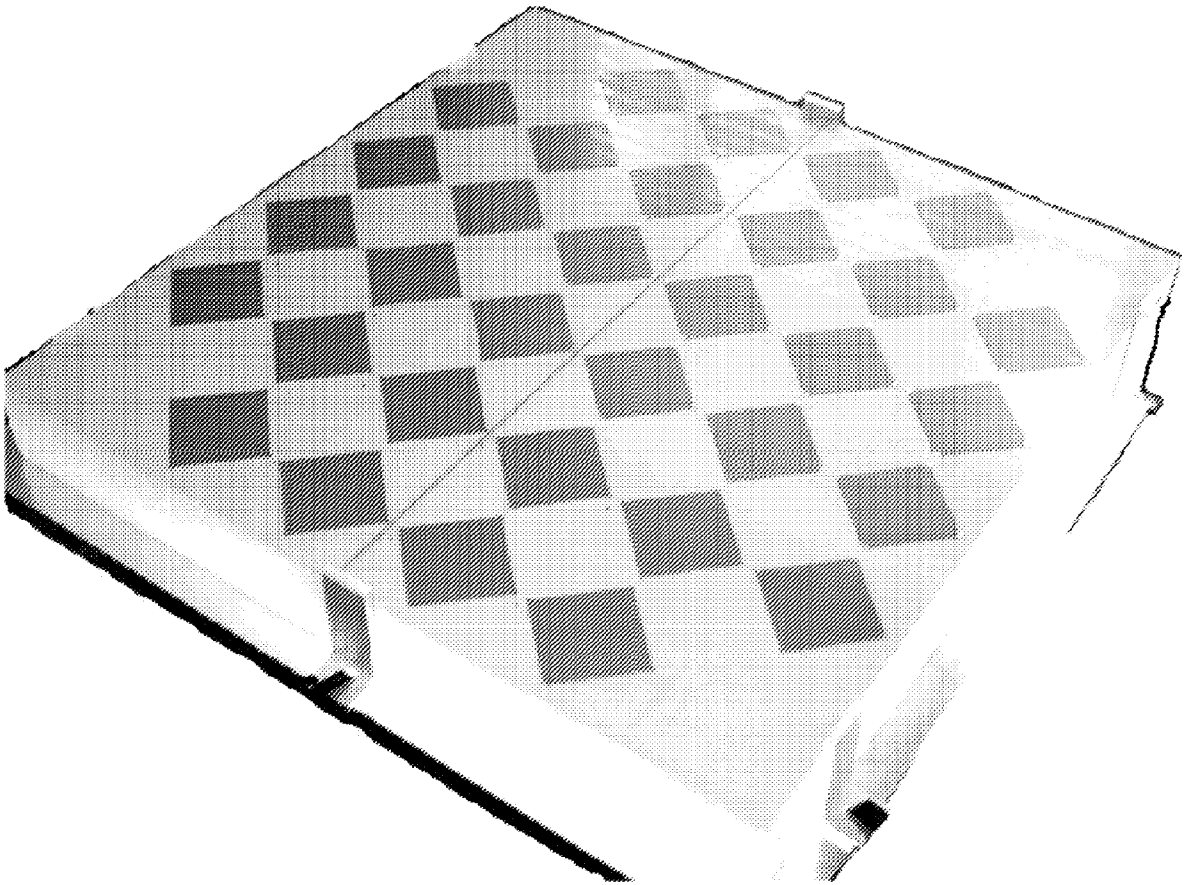
FIG. 2 is a photograph of a prototype checkerboard focal plane array.

The self-complementary concept can be used, with modification, in the ASKAP prototype focal-plane array shown 30 in photographic form in FIG. 2. The array uses a self-complementary array of connecting patches in a checkerboard arrangement. To obtain directivity, the self-complementary checkerboard is placed parallel to a ground plane. This introduces frequency dependence to the array impedance but a useful frequency range can still be obtained around the point where the ground plane is ¼ of a wavelength from the checkerboard and the array impedance is z0=377 ohm, rather than z0/2 in the case without the ground plane. Low-noise amplifiers (LNAs), with input impedance approximately equal to z0, are connected between the corners of neighbouring patches, via two-wire transmission lines that divert the signals to the other side of the ground plane, where the LNAs are located.

Figure 3:
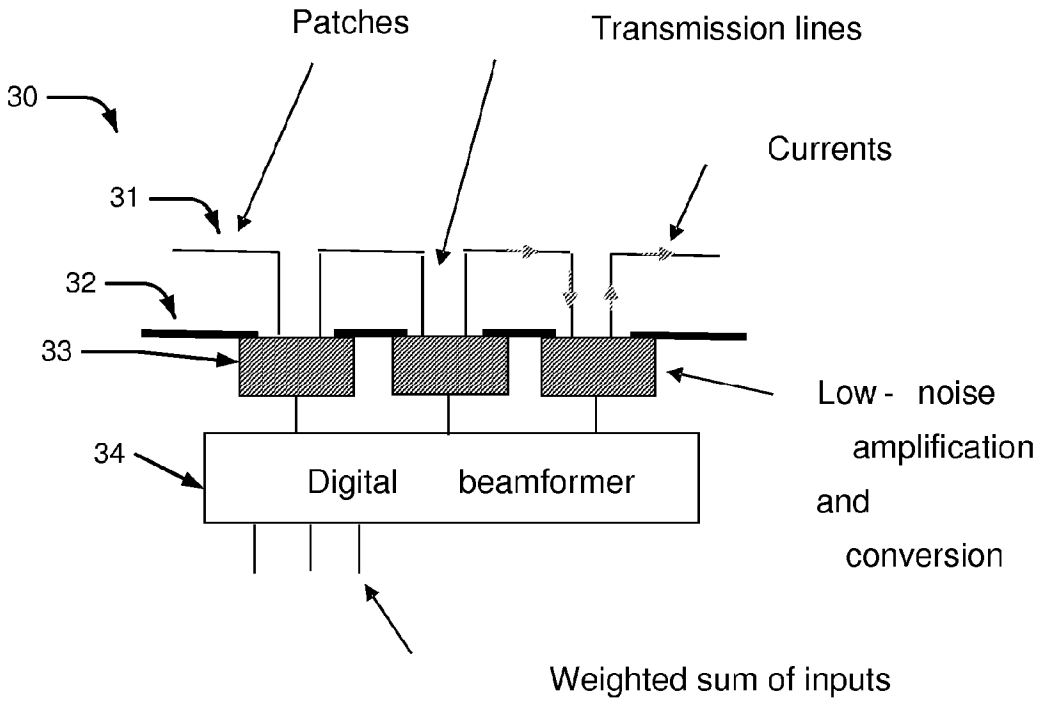
FIG. 3 is a schematic illustration of a sectional view through the antenna structure.

For benefit of understanding of the antenna construction process, FIG. 3 illustrates schematically a sectional view of the antenna 30 which includes a series of conductive patch regions 31, active above a ground plane 32. The patches are interconnected to LNAs 33 and are driven by a digital beamformer 34.

Figure 4:
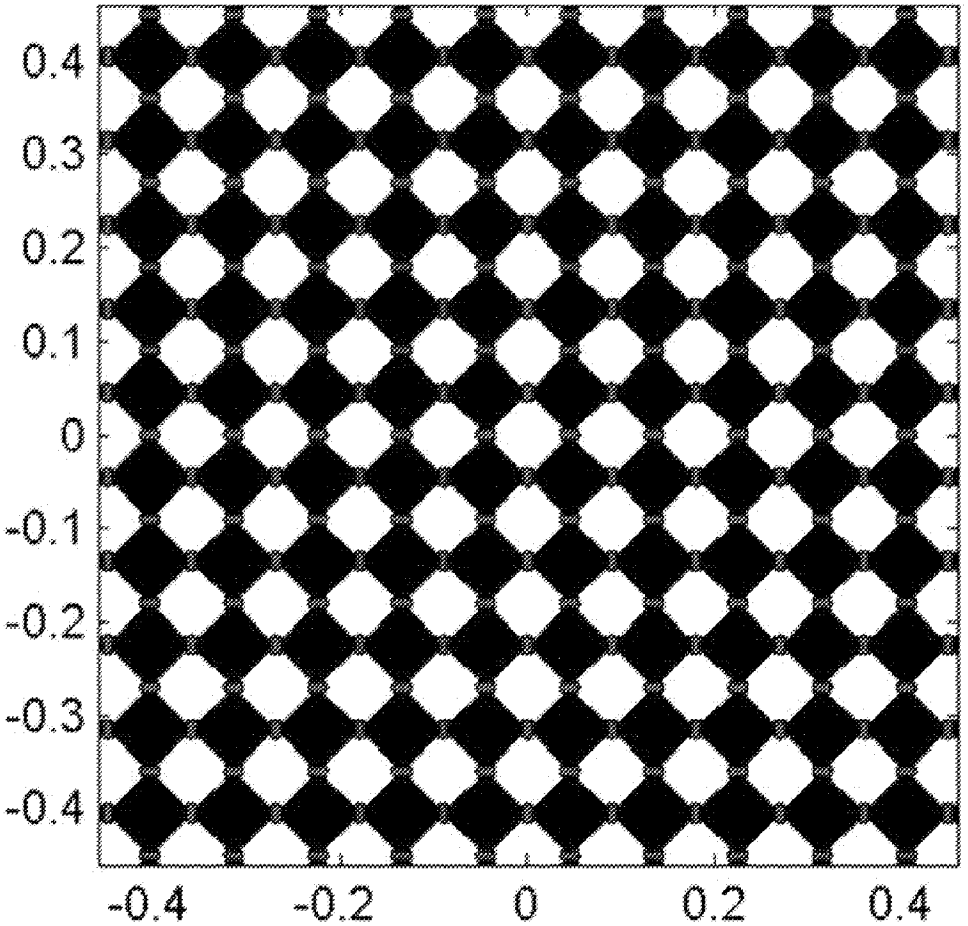
FIG. 4 illustrates schematically a first example self complementary checkerboard array and FIG. 5 illustrates the complementary array.
Figure 5:
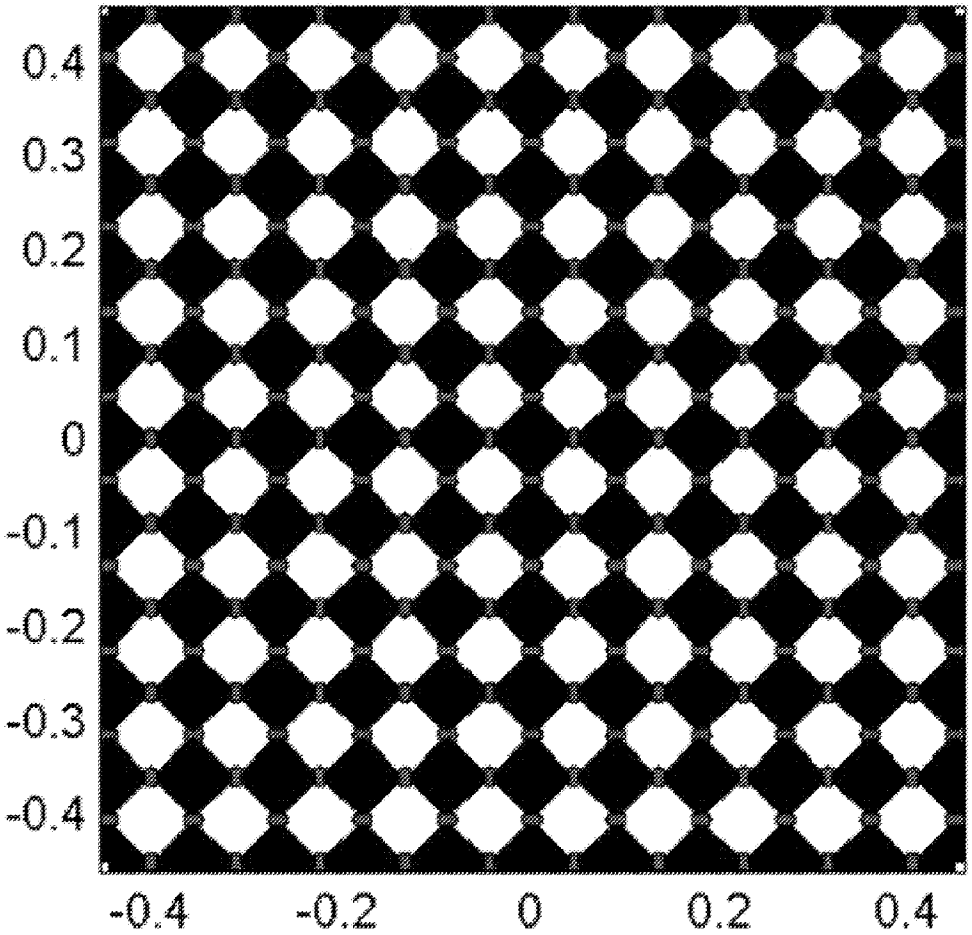

FIG. 4 and FIG. 5 illustrate the self-complementary principle in the case of the checkerboard array, with FIG. 5 showing the complimentary form of FIG. 4. The black regions are the conducting patches of low impedance, the white regions between the patches have high impedance. At the corner point of each diamond there is a region for electrical circuits to connect to the array. In a centre line there are no interconnects. Otherwise the interconnects are shown at the edge of each diamond portion is the feed region where the electronic circuits are connected to the array. Thus each interconnection region can be associated with an array element. The example shown in FIG. 4 and the complimentary form, FIG. 5, comprises a total of 11×10×2=220 array elements. The individual array signals are digitized and then linearly combined in the digital beamformer.

To fully sample an incident electromagnetic field or, equivalently, to produce beams whose radiation patterns can be controlled in all directions, the spacing of the array elements must be less than ½ the wavelength. Thus when operating over a large frequency range is required, the element spacing must be very much smaller than ½ the wavelength at low frequency. Nevertheless, all of the array signals must be combined by the digital beamformer in order to maintain high efficiency in the conversion of energy from the electromagnetic field to the beamformed signal. If a reduced number of array signals are beamformed, then significant loss in efficiency occurs, the reduced efficiency being less than that of a well-designed narrow-band array operating at the same frequency.

Reconfigurable Self-Complementary Arrays

Figure 6:
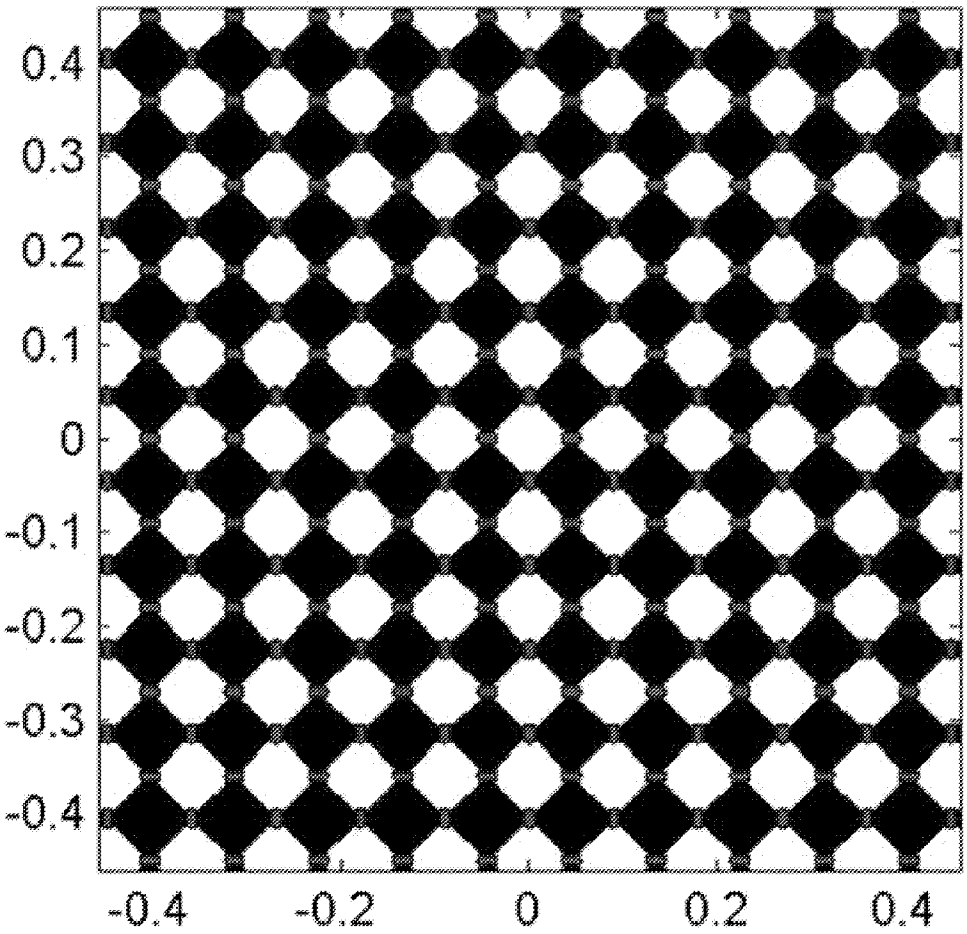
FIG. 6 illustrates schematically a second reconfigurable self complementary array, with FIG. 7 illustrating the array in complementary form; and FIG. 8
Figure 7:
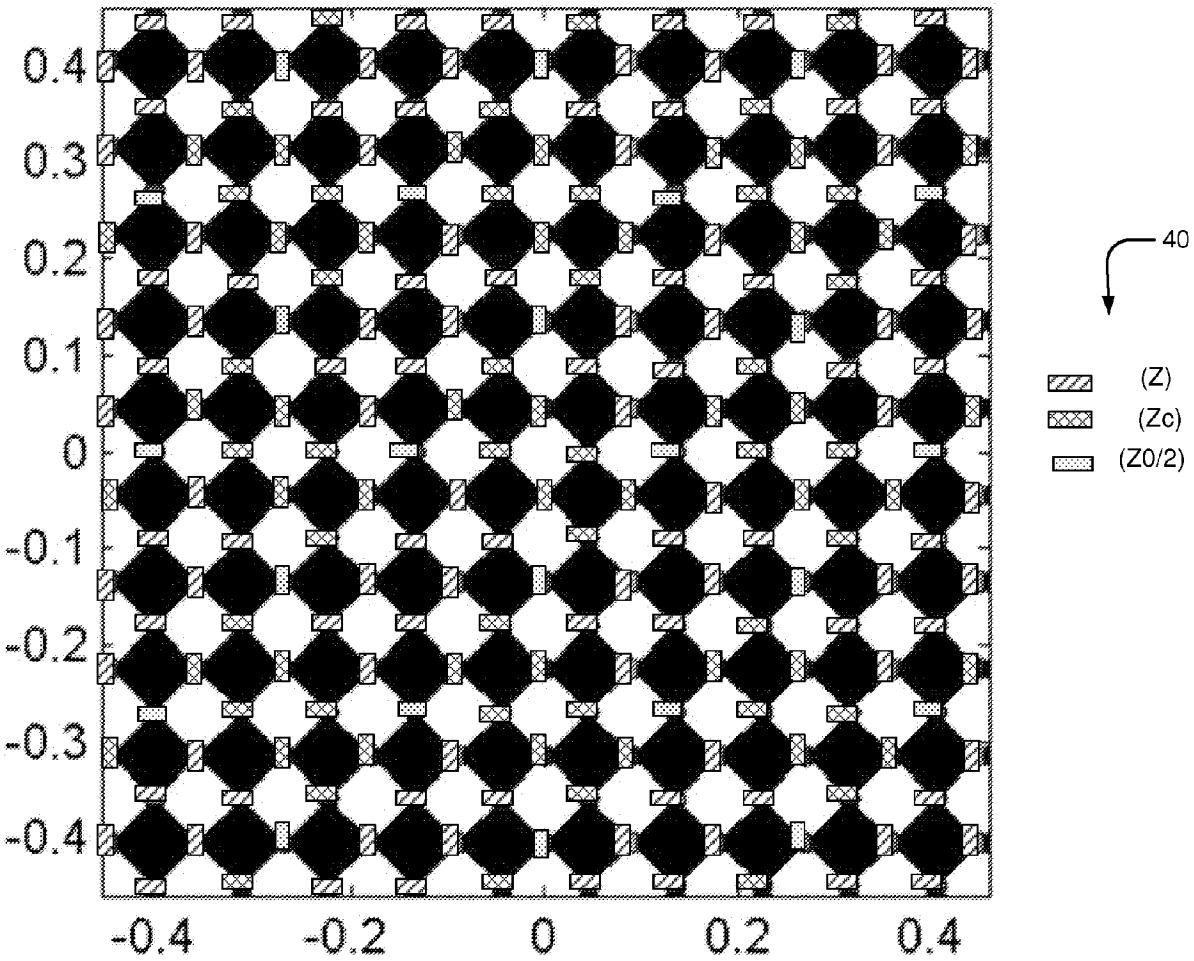

FIG. 6 and FIG. 7 illustrates the concept of the reconfigurable self-complementary array. In FIG. 5, the array is the familiar checkerboard uniformly loaded with LNAs between most of the diamond portions of the array. The idea is to switch out the uniform LNAs to obtain other self-complementary states by switching out LNAs and replacing them with complementary pairs as indicated in accordance with the legend 40 (FIG. 7), having reactive impedances Z, Zc, such as the input impedances of a length of transmission line terminated in open or short circuits, with the characteristic impedance of the transmission line equal to the LNA impedance. Such reactive impedances absorb no energy from the incident electromagnetic but redirect the energy so that it is efficiently received by the remaining LNAs. Both arrays are self-complementary with respect to the diamond edges implying wideband constant impedance at these points.

Figure 8:
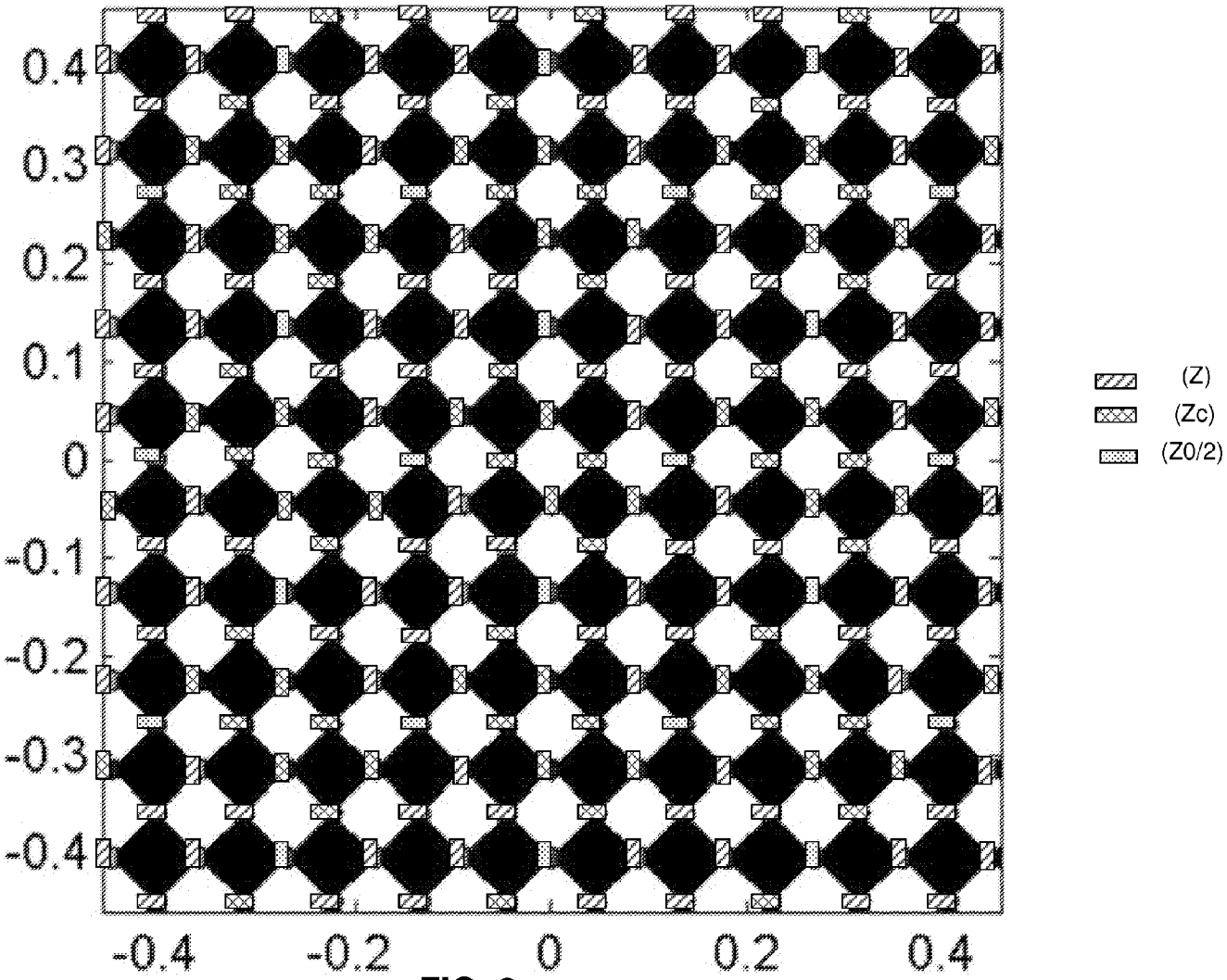
Figure 9:
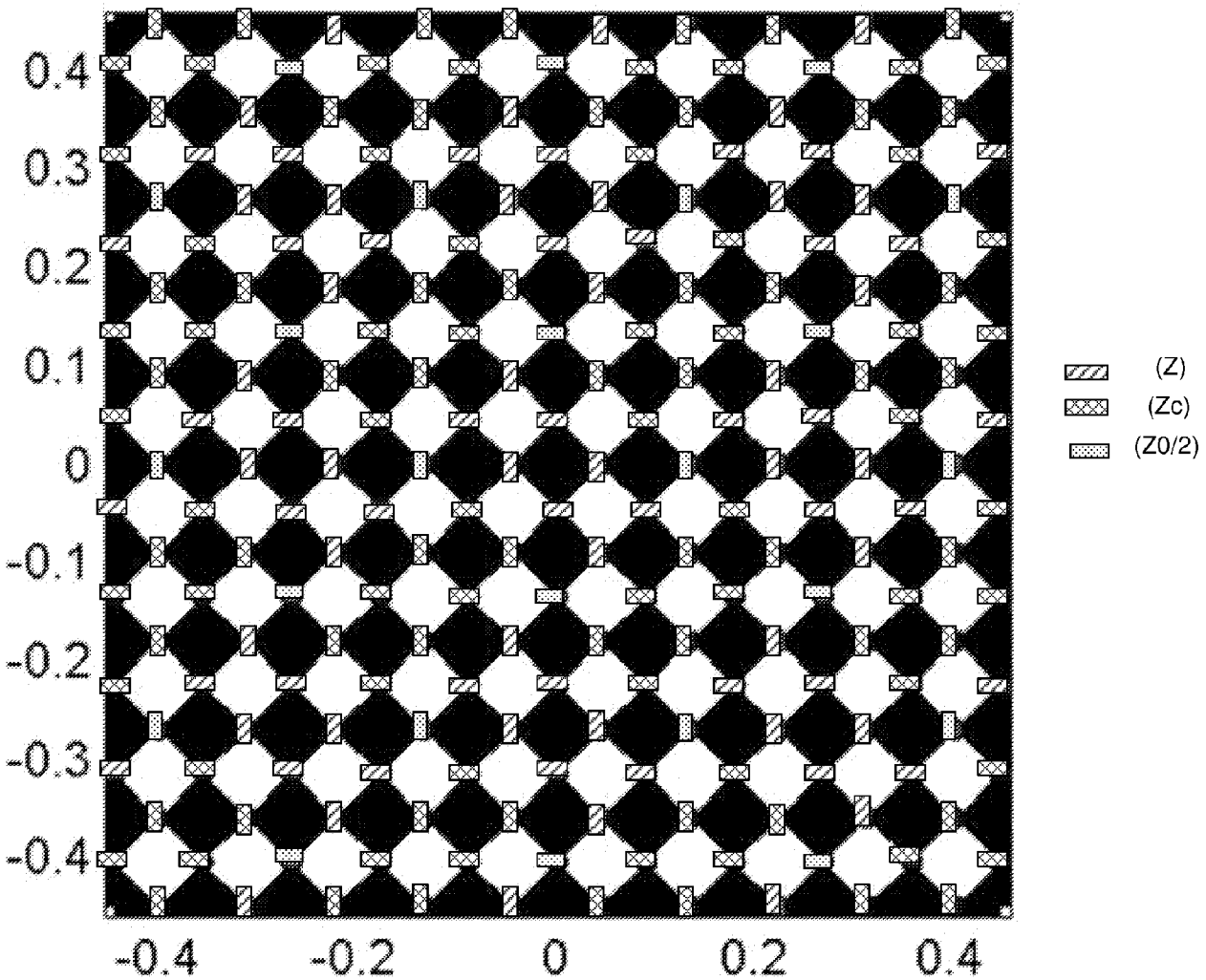
FIG. 9 illustrates a further example self complementary array.

FIG. 8 and FIG. 9 illustrates the self-complementary nature of a reactively loaded array. In FIG. 8, the array 50 is loaded with LNAs of impedance as indicated in the legend, including z0/2 and complementary pairs z and zc of reactive impedances satisfying z×zc=(z0/2)×(z0/2). FIG. 9 represents the complementary state to FIG. 8.

To verify the concept, an electromagnetic analysis of the two arrays illustrated in FIG. 7 and FIG. 8 was undertaken. Both arrays were analysed as realistic structures including the ground plane and transmission lines between the checkerboard and ground plane. The arrays were analysed at 0.6 GHz with the ground plane ¼ wavelength from the checkerboard. Conjugate-match beamforming of the array signals was performed to maximize power transfer to/from a plane wave propagating in the direction normal to the array. The loading impedances applied to the arrays where 377 ohm and short circuit and open circuit applied at the ground plane via the 377 ohm transmission lines. The computed results indicate that both arrays are relatively well matched to the 377 ohm loading impedance. One measure is the transmit-mode radiation efficiency. This is about 96% for the array with dense 377 ohm loads and 94% for the array with sparse 377 ohm loads. The dense array has 220 elements spaced approximately ⅙ wavelengths apart whereas the array with reactive loads has only 25 elements spaced approximately ½ wavelengths apart. This represents a reduction of about a factor of 10 in the number of beamformed signals.

The constructed arrangement provided a suitable antenna structure for the transmission or receipt of electromagnetic signals, with the structure formed as a self complementary array having a series of high and low impedance patches, with predetermined low impedance patches interconnected to one another by an impedance matching amplifier network so as to provide self complementary properties.

Interpretation

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of exemplary embodiments of the invention, various features of the invention are sometimes grouped together in a single embodiment, Fig., or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

Similarly, it is to be noticed that the term coupled, when used in the claims, should not be interpreted as being limitative to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Although the present invention has been described with particular reference to certain preferred embodiments thereof, variations and modifications of the present invention can be effected within the spirit and scope of the following claims.

I claim:

1. An antenna structure for the transmission or receipt of electromagnetic signals, the structure formed as a self-complementary array having a series of high and low impedance patches, with predetermined low impedance patches interconnected to one another by an impedance matching amplifier network, with the amplifier network including predetermined complementary pairs of reactive impedances so as to provide self-complementary properties.

2. The antenna structure as claimed in claim 1 wherein the low impedance patches substantially form a checkerboard pattern.

3. The antenna structure as claimed in claim 2 wherein the vertices of substantially adjacent patches are electrically interconnected.

4. The antenna structure as claimed in claim 1 wherein said impedance matching amplifier network can be switched between a number of different self-complementary states.

5. The antenna structure as claimed in claim 1 wherein a ground plane structure is provided a predetermined distance from the high and low impedance patches.

6. The antenna structure as claimed in claim 3 wherein the vertices are electrically interconnected utilizing low noise amplifiers.

7. The antenna structure as claimed in claim 5 wherein the ground plan structure is substantially planar and is substantially one quarter of the desired operating wavelength distance from the high and low impedance patches.

8. The antenna structure as claimed in claim 7 wherein a series of low noise amplifiers interconnect predetermined ones of the patches through the ground plane structure.

9. The antenna structure as claimed in claim 1 wherein said low impedance patches spacing is less than one half the desired operating wavelength.

10. The antenna structure as claimed in claim 1 wherein the patches are substantially diamond or square shaped.

11. An antenna structure as claimed in claim 1 for the transmission or receipt of electromagnetic signals, the structure formed as a self-complementary array having a series of high and low impedance areas interconnected with a switchable impedance matching network.

12. The antenna structure as claimed in claim 1 wherein said predetermined complementary pairs of reactive impedances have impedances z and zc respectively, where z×zc is substantially constant.

13. The antenna structure as claimed in claim 12 wherein $z \times zc = (z0/2) \times (z0/2)$, where z0 is about 377 ohms.

* * * * *